United States Patent [19]

Kawakami et al.

[11] Patent Number: 4,632,645

[45] Date of Patent: Dec. 30, 1986

[54] VIBRATING COMPRESSOR

[75] Inventors: Naoya Kawakami; Yoshiaki Fujisawa, both of Nitta, Japan

[73] Assignee: Sawafuji Electric Co., Ltd., Japan

[21] Appl. No.: 797,243

[22] Filed: Nov. 12, 1985

[30] Foreign Application Priority Data

Nov. 22, 1984 [JP] Japan ..... 59-247296

[51] Int. Cl.[4] ..... F04B 17/04; F04B 21/04; H02K 33/00

[52] U.S. Cl. ..... 417/417; 417/552; 310/27

[58] Field of Search ..... 417/363, 417, 545, 547, 417/552, 410; 310/27

[56] References Cited

U.S. PATENT DOCUMENTS

| | | | |
|---|---|---|---|
| 3,597,122 | 8/1971 | Farmer | 417/417 |
| 3,781,140 | 12/1973 | Gladden | 417/417 |
| 3,814,550 | 6/1974 | Adams | 417/417 |
| 3,842,809 | 10/1974 | King | 417/417 |
| 3,903,438 | 9/1975 | Dolz | 310/27 |
| 4,027,211 | 5/1977 | Omura et al. | 417/417 |
| 4,121,125 | 10/1978 | Dolz | 310/27 |
| 4,374,330 | 2/1983 | Fey | 417/415 |
| 4,416,594 | 11/1983 | Ichikawa | 417/417 |
| 4,427,906 | 1/1984 | Kainuma et al. | 417/416 |

*Primary Examiner*—Carlton R. Croyle
*Assistant Examiner*—Timothy S. Thorpe
*Attorney, Agent, or Firm*—McGlew and Tuttle

[57] ABSTRACT

A vibrating compressor comprising an external iron core, a permanent magnet, an internal iron core, and an electrocmagnetic coil vibratably supported by a mechanical vibrating system in a magnetic gap between the two iron cores to drive a piston connected thereto; the permanent magnet being composed of a high residual (remanence) magnetic flux density magnet, as represented by an alnico magnet, and a high coercive force magnet, as represented by ferrite magnet, and disposed separately.

7 Claims, 11 Drawing Figures

VIBRATING COMPRESSOR

BACKGROUND OF THE INVENTION (1) Field of the Invention

This invention relates generally to a vibrating compressor, and more specifically to a vibrating compressor comprising an external iron core, a permanent magnet, an internal iron core, and an electromagnetic coil vibratably supported by a mechanical vibrating system in a magnetic gap between the two iron cores to drive a piston connected thereto; the permanent magnet being composed of a high residual (remanence) magnetic flux density magnet, as represented by an alnico magnet, and a high coercive force magnet, as represented by a ferrite magnet, and disposed separately.

(2) Description of the Prior Art

Heretofore, there are two types of vibrating compressors; one type using a ferrite magnet as the high coercive force magnet, as shown in FIG. 1, and another using an alnico magnet as the high residual magnetic flux density magnet, as shown in FIG. 2. First, the vibrating compressor using a ferrite magnet will be described, referring to FIG. 1. A ferrite magnet 200 as a permanent magnet is formed into a hollow cylindrical shape going to consider the magnetic characteristics thereof and the outside diameter of the vibrating compressor, and disposed along the annular side surface of a cup-shaped external iron core 300. The ferrite magnet 200 is magnetized in the through-thickness, or radial, direction. An internal iron core 400 is provided to form a magnetic path together with the external iron core 300. An annular magnetic gap 500 is formed in a space between a magnetic pole 400' formed on the internal iron core 400 in such a manner as to oppose to the inner circumferential surface of the ferrite magnet 200 and the inner surface of the ferrite magnet 200. In the annular magnetic gap 500, disposed is an electromagnetic coil 100 vibratably supported by a pair of opposing resonating springs 600 and 700 via a coil support 800. A piston 900 is constructed substantially integrally with the electromagnetic coil 100 via the coil support 800, and is driven by the electromagnetic coil 100 to reciprocate in the vertical direction. A cylinder block 130 having a compression cylinder 110 engaged with the piston 900 is fixedly fitted by means of cylinder fixing bolts 150 to the external iron core 300 via a distance case 140. In the vibrating compressor having such a construction, when an alternating current is fed to the electromagnetic coil 100 via a lead terminal 180 and a lead wire 180', the electromagnetic coil 100 is caused to vibrate in accordance with the frequency of the alternating current to drive the piston 900. The reciprocating motion of the piston 900 causes a refrigerant, such as R12 gas, to flow from an inlet port 160 into a housing 190 in the direction shown by dotted-line arrows. The refrigerant, passing through an inlet pipe 160', is further introduced into the compression cylinder 110. The refrigerant flowing in between an suction valve 1000 and a discharge valve 120 is compressed by the piston 900. The compressed refrigerant is discharged in the direction shown by solid-line arrows through an outlet pipe 170' and an outlet port 170 into a refrigerating system condenser (not shown). The suction or discharge of refrigerant in the compression cylinder 110 is effected as the suction valve 1000 and the discharge valve 120 alternately open and close in accordance with the reciprocating motion of the piston 900. In this type of vibrating compressor using a ferrite magnet, the compressor performance is substantially deteriorated by temperature rise because the magnetic characteristics of ferrite magnets are lowered by approx. 18% by a temperature rise of 100° C. This is not favorable for use in applications where a temperature rise of approx. 100° C. is expected. Furthermore, a temperature difference of this degree often exists between the startup period and the steady-state operation of the compressor. For this reason, an attempt to maintain the compressor performance during the steady-state operation could increase the stroke of the piston excessively at the startup period, increasing the danger of the piston colliding against the discharge valve 120.

Next, the vibrating compressor using an alnico magnet will be described, fererring to FIG. 2. In the figure, like numerals represent like parts having the same functions as those shown in FIG. 1. Description of such parts is therefore omitted, and only those having different constructions will be described. Whereas the permanent magnet in the vibrating compressor shown in FIG. 1 is a ferrite magnet 200, that shown in FIG. 2 is an alnico magnet 200. The alnico magnet 200 is disposed in between the inside flat surface of the cup-shaped external iron core 300 and the top surface of the internal iron core 400. The alnico magnet 200 is magnetized in the height, or axial, direction. This type of vibrating compressor using an alnico magnet has the following drawbacks. The alnico magnet generally tends to be readily demagnetized, when an excess current flows in the electromagnetic coil 100, because it has a low coercive force and its inflection points exist in the second quadrant of the B-H curve. In addition, it is expensive because of the high cobalt content.

SUMMARY OF THE INVENTION

This invention is therefore intended to overcome the aforementioned problems.

It is an object of this invention to provide a vibrating compressor whose permanent magnet is composed of a combination of a high coercive force magnet, as represented by a ferrite magnet, and a high residual magnetic flux density, as represented by an alnico magnet; the ferrite and alnico magnets being combined in series into a more compact form than the permanent magnet composed of a ferrite or alnico magnet alone, whereby offsetting the drawbacks of and fully utilizing the advantages of the two types of magnets to improve the magnetic characteristics of the entire compressor.

It is another object of this invention to provide a vibrating compressor having a cylindrical body comprising a yoke, or an external iron core, and a bottom integrally formed thereon wherein provision is made to prevent the formation of a possible gap between the yoke and the permanent magnet due to a shouldered portion formed during turning the cylindrical body with a lathe or other machine tool.

It is still another object of this invention to provide a vibrating compressor having a mounting groove provided along the entire periphery of the inside surface of the abovementioned other end of the yoke, projections constituting the side surface of the yoke at said other end, a ring-shaped mounting plate, made of a resilient material with the part thereof being cut; the mounting plate having a plurality of threaded holes for mounting on the mounting groove and locating holes at circumferential positions close to both ends of the mounting plate, in which a closing member is fixed at said other end of the yoke by means of screws screwed into the threaded holes on the mounting plate; and the mounting plate is fitted to the mounting groove by raising the projections upward in such a state where the entire outer circumferential surface of the mounting plate is brought into contact with the bottom surface of the mounting groove while expanding the gap at both ends of the mounting plate.

It is a further object of this invention to provide a vibrating compressor having such a construction that a compressor proper incorporating a compressor driven by a certain type of motor, such as a swing motor, is resiliently supported by a resilient member, such as a spring, at least at one end face thereof, in which a cushioning device for causing the side surface of a projection provided on the end face of the compressor proper to resiliently slide is provided to prevent the unwanted vibration of the compressor proper; and a wear-resistant sliding plate is fixedly fitted to the sliding surface of the cushioning device to prevent the wear of the cushioning member.

BRIEF DESCRIPTION OF THE DRAWINGS

FIG. 10 (B) illustrates a wave washer used in FIG. 10 (A).

DESCRIPTION OF THE PREFERRED EMBODIMENT

Figure 3:
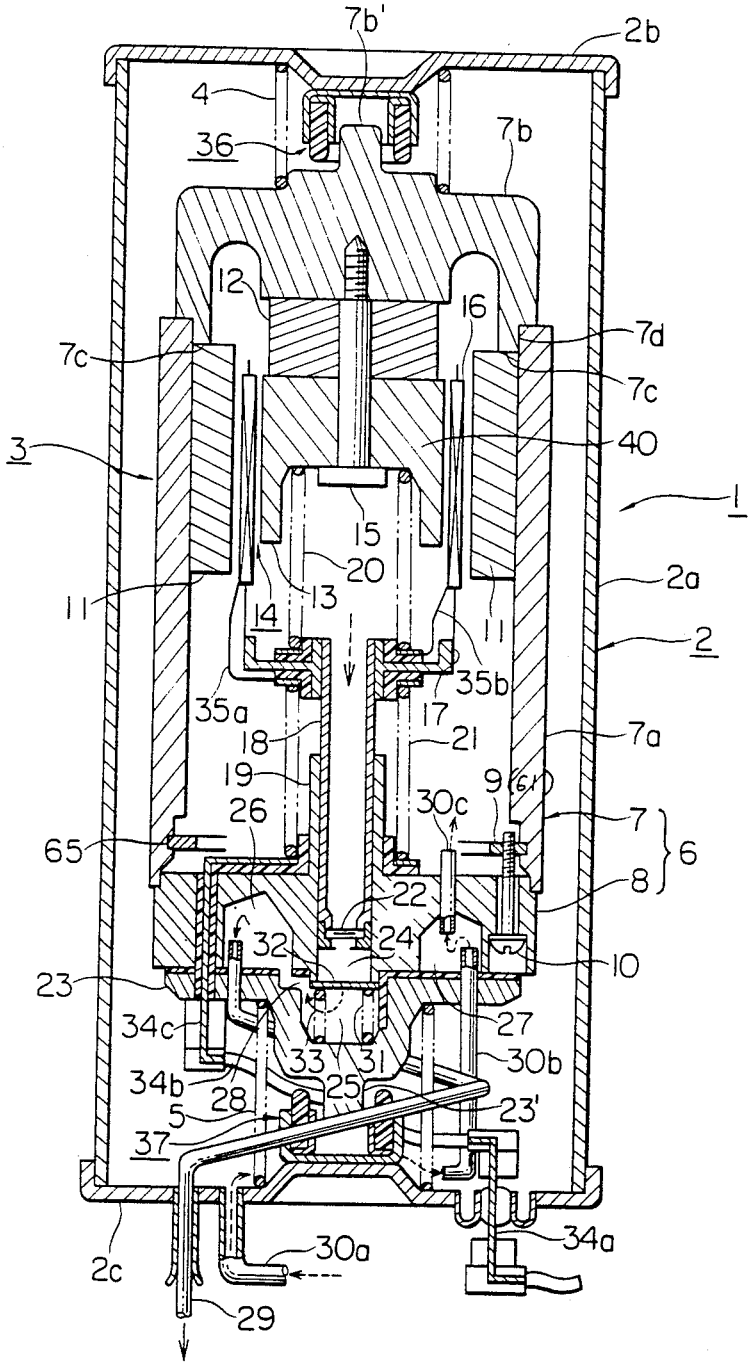
FIG. 3 is a crosssectional view of a vibrating compressor embodying this invention.

In FIG. 3, the vibrating compressor 1 of this invention has such a construction that a compressor proper 3 is resiliently supported by springs 4, 5 and other means in a cylindrical enclosed container 2 comprising a cylindrical portion 2*a* and cover plates 2*b*, 2*c* for closing both open ends of the cylindrical portion 2*a*.

Figure 1:
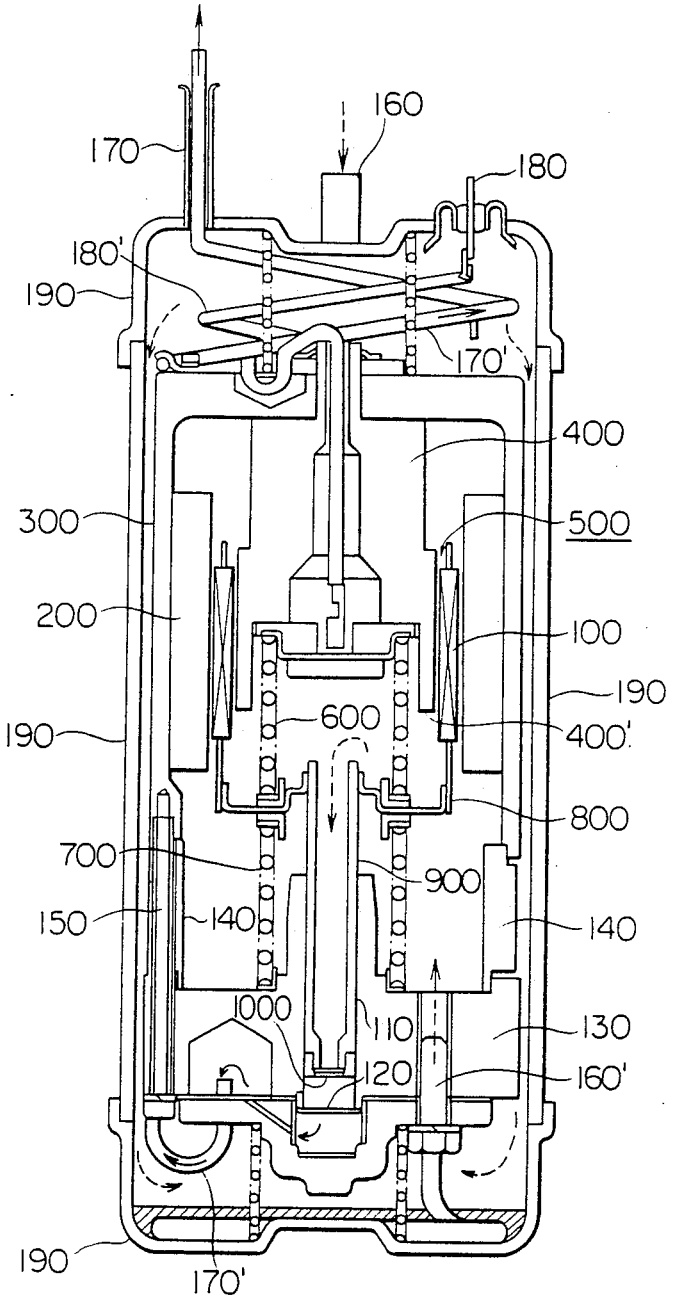
FIG. 1 (PRIOR ART)
FIG. 1 is a crossectional view of a conventional type of vibrating compressor using a ferrite magnet.
Figure 2:
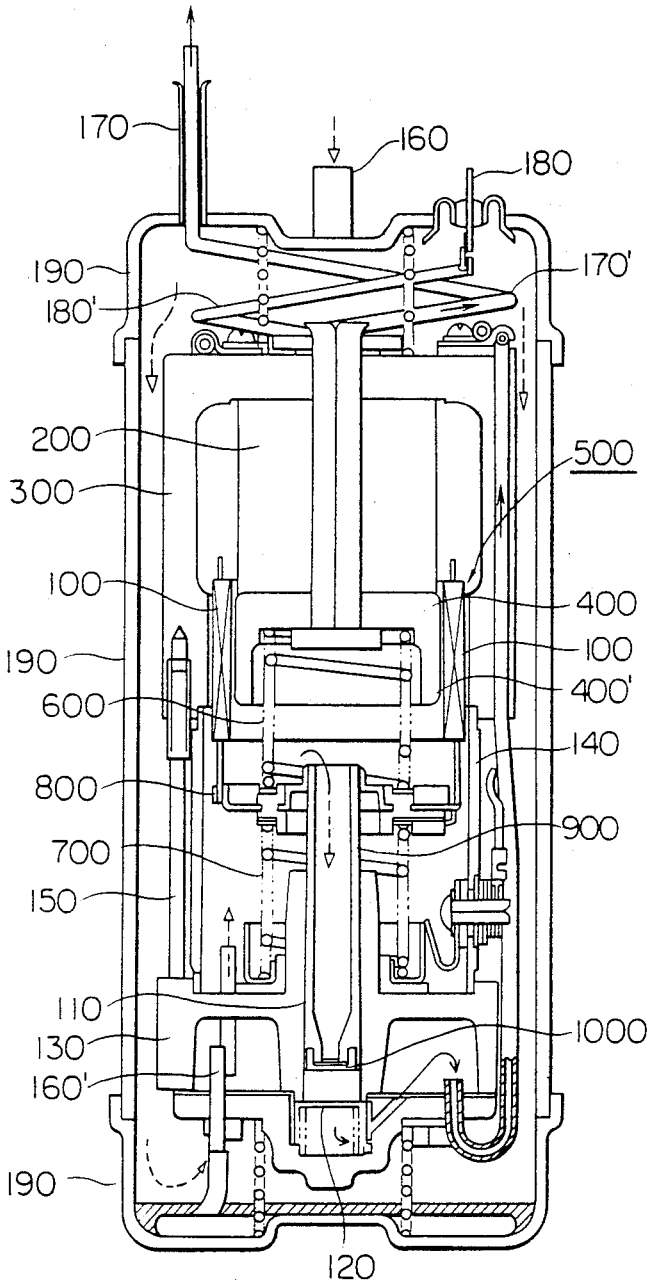
FIG. 2 (PRIOR ART)
FIG. 2 is a crosssectional view of a conventional type of vibrating compressor using an alnico magnet.

A casing 6 of the compressor proper 3 consists of an external iron core, or yoke 7 and a closing member 8. The upper end of the yoke 7 has such a construction that one end, that is, an upper end, of a cylindrical part 7*a* is closed by a bottom 7*b*. And, the closing member 8 is fixedly fitted to the other end of the yoke 7, that is, a lower end, of the cylindrical part 7*a*. In the casing 6 comprising the yoke 7 and the closing member 8, provided are two types of permanent magnets, an alnico magnet 12 and a ferrite magnet 11, which are disposed at different locations, as shown in FIG. 3. The alnico magnet 12 is magnetized in the axial direction of the compressor, while the ferrite magnet 11 in the radial direction of the compressor. The length of the ferrite magnet 11 in the axial direction of the compressor is adapted to be longer than the axial length of a pole piece 13 formed on the internal iron core 40 so as to keep the magnetic flux density within an annular magnetic gap 14 uniform. A magnetic path with respect to the permanent magnets is formed by the cylindrical part 7*a*, the bottom 7*b*, the internal iron core 40, and the pole piece 13. Within a magnetic gap 14 defined by the cylindrical part 7*a*, *l the bottom* 7*b* and the internal iron core 40, disposed in an electromagnetic coil, that is, a driving coil 16, which is vibratably supported by the mechanical vibrating system via resonating springs 20 and 21. A piston 18 is integrally connected to the driving coil 16 via a coil supporting member 17. The alnico magnet 12 and the ferrite magnet 11 in the vibrating compressor of this invention can be reduced in the height and thickness thereof, compared with the size of the ferrite or alnico magnet 200, which is used singly, as shown in FIGS. 1 and 2, respectively. With this arrangement, what is to be done is simply designing both magnets 12 and 11 in such a fashion that the total magnetomotive force thereof equals to the magnetomotive force of each magnet 200, which would be used singly, as shown in FIGS. 1 and 2. Tha ratio of the magnetomotove forces of both magnets 12 and 11 depends solely on specific requirements for the compressor.

The bottom 7*b* in the figure is formed by turning, for example, a cup-shaped forging to provide a shoulder part 7*c* which intersects vertically with the inner circumferential surface of the cylindrical part 7*a*, and an engaging part 7*d* which engages with the inner circumferential surface of the cylindrical part 7*a*. Thus, the yoke 7 is constructed by engaging the engaging part 7*d* with the inner circumferential surface of the cylindrical part 7*a* and fixing (welding, for example) both. The closing member 8 is formed into an essentially thick disk-like piece and engaged with the lower end of the yoke 7. On the lower part of the inner circumferential surface of the yoke 7, fitted is a mounting plate 9, which is formed into a ring-shaped disk with a part thereof cut off. The closing member 8 is fixedly fitted to the lower end of the yoke 7 by fastening the closing member 8 to the mounting plate 9 with a plurality of screws 10.

The hollow cylindrical ferrite magnet 11 is fixedly fitted inside the casing 6 in such a manner that the ferrite magnet 11 comes in contact with the inner circumferential surface of the yoke 7 and the shoulder part 7*c*. In this invention, the inner circumferential surface of the yoke 7 intersects at precisely right angles with the shoulder part 7*c*, and the corner of the ferrite magnet 11, at which the outer circumferential surface intersects thereof with the end face thereof, is formed precisely squarely, as described earlier. This permits the ferrite magnet 11 to be fitted in close contact with the yoke, that is, in a state no gap exists between the ferrite magnet 11 and the yoke 7, thus preventing an unwanted gap from being formed in a magnetic path constituted by the ferrite magnet 11, the yoke 7, the alnico magnet 12, and the pole piece 13. This contributes much to reduced magnetic resistance in the magnetic path.

Figure 4:
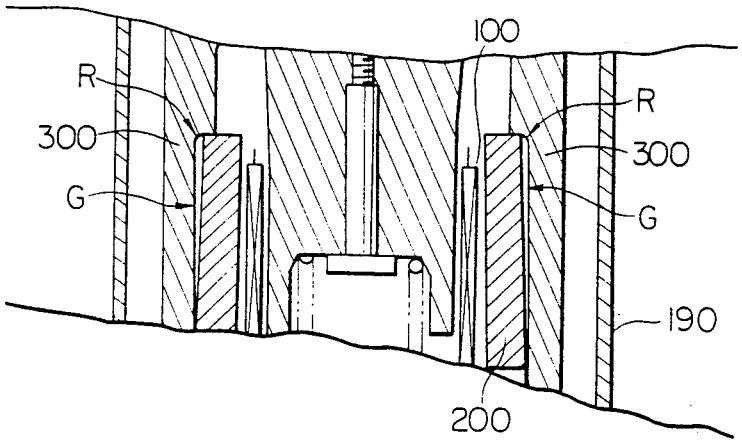
FIG. 4 (PRIOR ART)
FIG. 4 is a crosssectional view of a conventional type of vibrating compressor illustrating a gap caused between the permanent magnet and the shouldered portion formed during turning of a cylindrical yoke.

In the conventional type of vibrating compressor, on the other hand, the inner circumferential surface of the external iron core 300 and the shouldered part thereof have heretofore been formed by lathe turning, as shown in the enlarged essential part in FIG. 4. This turning operation, however, is not easy and involves much labor and time because the shouldered part is located away from the open end of the external iron core 300. In addition, the turning of the inner circumferential surface and shouldered part of the external iron core 300 tends to cause a certain degree of fillet radius (of approx. 0.4 mm) at the intersection (shown by an arrow R in FIG. 4) of the inner circumferential surface and the shouldered part. This rounded fillet would not fit tightly on the corner of the ferrite magnet 200, which is generally formed squarely, causing an unwanted gap (shown by an arrow G in FIG. 4) between the ferrite magnet 200 and the external iron core 300.

It should be noted that the pole piece 13 is fixedly fitted to the bottom 7*b* by the alnico magnet 12 by means of a screw 15.

The driving coil 16 is disposed in the gap 14 so that the driving coil 16 can reciprocate in the axial direction, that is the vertical direction of the casing 6. The driving coil 16 is wound around the coil supporting member 17, which is fixedly fitted to the cylindrical piston 18 disposed concentrically with respect to the axis of the casing 6. The driving coil 16 is therefore formed substantially integrally with the piston 18. The piston 18 comes in sliding contact with a cylinder 19, which is provided integrally with the closing member 8 in such a manner as to protrude into the casing 6. The resonating spring 20 is interposed between the pole piece 13 and the coil supporting member 17, while the resonating spring 21 is interposed between the coil supporting member 17 and the closing member 8. Consequently the piston 18 is supported by a pair of the upper and lower resonating springs 20 and 21. Furthermore, an suction valve 22 is provided at the lower end of the piston 18.

A cap-shaped cover 23 is fixedly fitted to the bottom of the closing member 8 by means of bolts (not shown). Between the cap-shaped cover 23 and the closing member 8, provided is a discharge chamber 25, which is located below a cylinder chamber 24 under the piston 18, and also provided are a high-pressure chamber 26 and a low-pressure chamber 27 by closing an opening provided on the closing member 8 with the cup-shaped cover 23. A connecting path 28 connecting the discharge chamber 25 and the high-pressure chamber 26 is grooved on the cap-shaped cover 23. A discharge pipe 29 connecting to the high-pressure chamber 26 is provided, which is passed through the cover plate 2*c*, and led to the outside to be connected to a refrigerator condenser (not shown), for example. The low-pressure refrigerant from a refrigerator evaporator (not shown) is introduced into the casing 6, that is, the inside of the compressor proper 3 via an inlet pipe 30*a* passing through the cover plate 2*c*, and an inlet pipe 30*b* connecting to the low-pressure chamber 27, and an inlet pipe 30*c* connecting to the low-pressure chamber 27 and the inside of the casing 6.

In the discharge chamber 25, housed are an discharge valve 32 which rests on a valve seat 31 provided on the closing member 8 at the lower part of the cylinder chamber 24, and a compression spring 33 for forcing the discharge valve 32 onto the valve seat 31.

A power feeding terminal 34*a* is installed on the cover plate 2*c*, and connecting members 34*b* and 34*c* are provided to connect the power feeding terminal 34*a* and the resonating spring 21. The drive coil 16 and the resonating spring 21 are connected with a lead wire 35*a*, while driving coil 16 and the resonating spring 20 are connected with a lead wire 35*b*. Consequently, one end of the driving coil 16 is connected to the power feeding terminal 34*a* via the lead wire 35*a*, the resonating spring 21, and the connecting members 34*c* and 34*b*, whereas the other end thereof is connected to the enclosed container 2 via the lead wire 35*b*, the resonating spring 20, the pole piece 13, the screw 15, the bottom 7*b* and the spring 4. Thus, an alternating current can be fed to the driving coil 16 by applying an alternating voltage across the power feeding terminal 34*a* and the enclosed container 2.

When an alternating current is fed to the electromagnetic coil, that is, the driving coil 16 of the vibrating compressor of this invention, the driving coil 16 is caused to vibrate in accordance with the frequency of the alternating current supplied, causing the piston 18 to reciprocate (in the vertical direction in FIG. 3). In this case, the natural frequency of the mechanical system of the vibrating compressor resonates with the frequency of the alternating current fed to the driving coil 16. The refrigerant, such as R12 gas, introduced from the inlet pipe 30*a* by the reciprocating motion of the piston 18 is led in the housing, that is, the enclosed container 2 in the direction shown by dotted-line arrows, and fed into the piston 18 through the inlet pipes 30*b* and 30*c*. The refrigerant is then compressed by the reciprocating motion of the piston 18 between the suction valve 22 mounted on the head of the piston 18 and the discharge valve 32 mounted on the bottom of the cylinder 19. The suction and discharge of the refrigerant in the cylinder 19 is effected as the suction valve 22 and the discharge valve 32 alternately open and close in accordance with the reciprocating motion of the piston 18. The high-pressure refrigerant compressed by the piston 18 is delivered in the direction shown by solid-line arrows, and discharged into the refrigerating system condenser, for example, through the discharge pipe 29.

The driving force of the vibrating compressor to continue the aforementioned operation is the driving coil 16 pro- vided in the magnetic gap 14 between the ferrite magnet 11 and the pole piece 13. And, the magnetic flux which intersects with the driving coil 16 in the magnetic gap 14 is generated by the ferrite magnet 11 and the alnico magnet 12. If an unwanted gap exists in the magnetic path including the magnets 11 and 12, however, the magnetic flux density in the magnetic gap 14 is decreased, resulting in lowered driving force. In this invention, no unwanted gap exists not only between the internal iron core 40 and the alnico magnet 12, the alnico magnet 12 and the bottom 7*b*, and the cylindrical part 7*a* of the yoke 7 and the bottom 7*b*, but also between the ferrite magnet 11 and the cylindrical part 7*a* of the yoke 7, with all the abovementioned components brought into close contact with each other. Thus, no losses are caused in the magnetic flux density in the magnetic gap 14.

Figure 5:
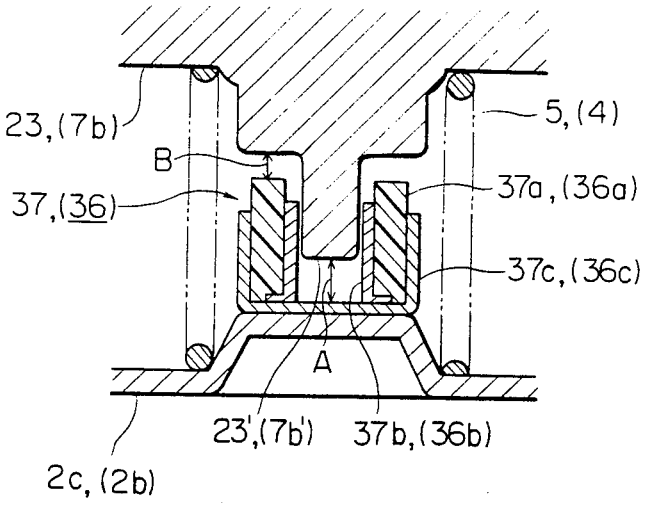
FIG. 5 is an enlarged view of the upper and lower cushioning devices provided on the vibrating compressor embodying this invention.

In this invention, projections 7*b*′ and 23′ are formed on the bottom 7*b* and the cap-shaped cover 23 constituting both ends of the compressor proper 3, and cushioning devices 36 and 37 are provided on the cover plates 2*b* and 2*c* at locations corresponding to the projections 7*b*′ and 23′, as shown in FIG. 5. If the compressor proper 3, which is resiliently supported by springs 4 and 5, as noted earlier, is subjected to unwanted vibration caused by an external impact, for example, or placed in a horizontal position, the support by the springs 4 and 5 might become unstable due to the influences of gravity. The cushioning devices 36 and 37 are provided to overcome this problem. In the following, the cushioning devices 36 and 37 will be described, referring to FIG. 5. FIG. 5 is an enlarged view of the cushioning device 37 shown in FIG. 3, the cushioning device 36 provided on the cover plate 2*b* also has the same construction.

As shown in FIG. 5, the cushioning device 37 (36) comprises a cylindrical cushioning member 37*a* (36*a*), made of a resilient material, such as rubber; a sliding plate 37*b* (36*b*), which is made of a wear-resistant material, such as a spring material, nylon sheet, and mounted on the inner circumferential surface of the cushioning member 37*a* (36*a*), and along which the side surface of the projection 23′ (7*b*′) slides; and a casing 37*c* (36*c*). The cushioning device 37 (36) is fixedly fitted to the cover plate 2*c* (2*b*) so that the side surface of the projection 23′ (7*b*′) can slide along the sliding plate 37*b* (36*b*).

In the vibrating compressor of this invention on which the cushioning devices 37 and 36 are mounted, as described above, the compressor proper 3 can be protected from the abovementioned unwanted vibration and supported stably since the compressor proper 3 is resiliently supported by the springs 4 and 5, and the projections 7*b*′ and 23′ are guided by the cushioning devices 36 and 37. In addition, the wear-resistant sliding plates provided on the cushioning devices of this invention help prevent the wear of the cushioning members. Furthermore, since a gap (shown by an arrow A in the figure) between the projection 23′ (7*b*′) and the casing 37*c* (36*c*) is made larger than a gap (shown by an arrow B in the figure) between the projection 23′ (7*b*′) and the cushioning member 37*a* (36*a*), the tip of the projection 23′ (7*b*′) never collides against the casing 37*c* (36*c*).

Figure 10A:
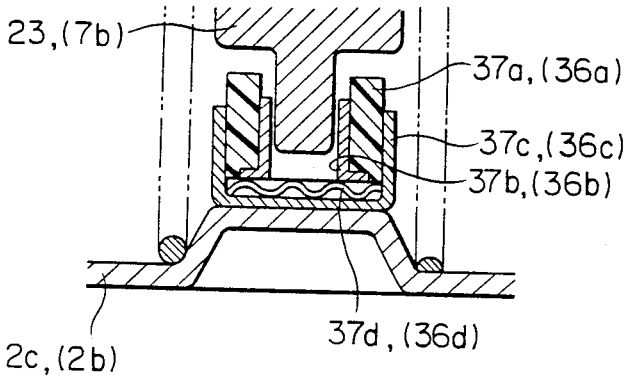
FIG. 10 (A) illustrates a variation of the cushioning device shown in FIG. 5.
Figure 10B:
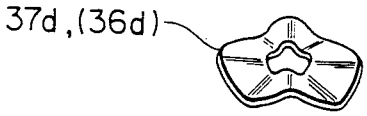

FIG. 10 (A) illustrates a variation of the cushioning device shown in FIG. 5. Reference numerals 2*c*, 2*b*, 23, 7*b*, 37*a*, 36*a*, 37*b*, 36*b*, 37*c* and 36*c* in the figure correspond with like numerals in FIG. 5. Numerals 37*d* and 36*d* denote wave washers as shown in the perspective view of FIG. 10 (B). In the cushioning device shown in FIG. 10 (A), the wave washer 37*d* (36*d*) is interposed between the cushioning washer 37*d* (36*d*) thus interposed between the cushioning member 37*a* (36*a*) and the casing 37*c* (36*c*) is adapted to have a smaller spring constant than the cushioning member 37*a* (36*a*), the initial repulsion force generated when the cap-shaped cover 23 (the bottom 7*b*) comes in contact with the cushioning member 37*a* (36*a*) can be reduced. Thus, when a relatively small impact is exerted from the outside, the compressor proper 3 can be prevented from generating a large repulsion force. When a large impact is exerted from the outside, the wave washer 37*d* (36*d*) is compressed totally, and the large resilient force of the cushioning member 37*a* (36*a*) can be fully utilized to absorb the impact.

In the vibrating compressor shown in FIG. 3, the mounting plate 9, which is of a ring-like disk shape with the part thereof cut away, is fitted by the resiliency of the mounting plate 9 itself to a mounting groove 65 provided at the bottom end of the yoke 7. The conventional type of the mounting plate 9, however, when engaged into the mounting groove 65, does not necessarily show a satisfactory resiliency in the radial direction (as the diameter of the mounting plate 9 is reduced to engage into the mounting groove 65). As a result, the outer circumferential surface of the mounting plate 9 often does not fit firmly into the bottom surface of the mounting groove 65, leading to the misalignment between holes of the mounting plate 9 and the closing member 8.

Figure 6:
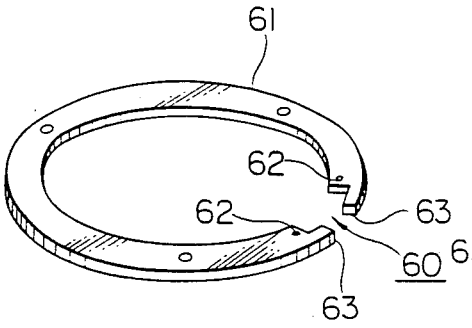
FIG. 6 is a perspective view of an example of a mounting plate used in the vibrating compressor of this invention.
Figure 8:
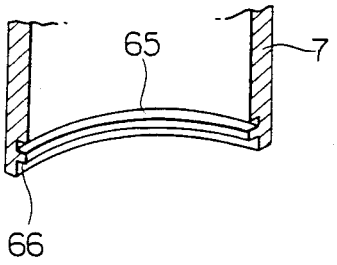
FIG. 8 is a perspective view of the lower end of the yoke used in the vibrating compressor of this invention shown in FIG. 3.

To overcome this problem, the mounting plate 61 used in this invention is made of a resilient material, as in the case of the conventional type of mounting plate 9 (shown in FIG. 9) used in the vibrating compressor proposed earlier, and formed into a circular arc shape having a cut-away part 60, as shown in FIG. 6. However, positioning holes 62 are provided on the mounting plate 61 of this invention at locations close to both ends of the mounting plate 61. The cut-away part 60 is formed in such a shape that shouldered parts 63 are protruded, as shown in FIG. 6. The positioning holes 62 are provided to facilitate the expansion and reduction of the diameter of the mounting plate 61 by means of a known tool. The mounting groove 65 to which the mounting plate 61 is fitted and a projection 66 are formed at the lower part of the yoke 7, as shown in FIG. 8.

Figure 7:
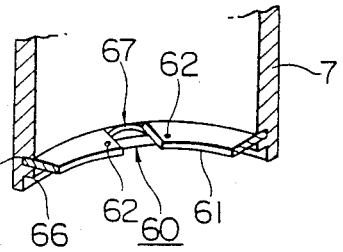
FIG. 7 is a diagram of assistance in explaining the state where the mounting plate shown in FIG. 6 is fitted to the cylindrical part.

The mounting plate 61 shown in FIG. 6 is inserted into the yoke 7 while reducing the diameter of the mounting plate 61 by squeezing both end thereof (this diameter reducing operation may be performed by means of an appropriate tool using the positioning holes 62), and engaged into the mounting groove 65 by releasing the compressed state of the mounting plate 61. After the mounting plate 61 thus engaged into the mounting groove 65 is positioned in the circumferential direction, the cut-away part 60 is fully expanded outward using the positioning holes 62. By doing this, the outer circumferential surface of the mounting plate 61 is forced onto, and brought into close contact with the bottom surface of the mounting groove 65 over the entire periphery thereof. In this state, the mounting plate 61 is fixed in position by crimping the cut-away part 60 by the projection 66, that is, by raising the projection 66 upward to engage with the cut-away part 60 as shown in FIG. 7. Numeral 67 in FIG. 7 indicates the crimped part of the projection 66. In this manner, the mounting plate 61 is securely held in position with respect to the yoke 7.

Figure 9:
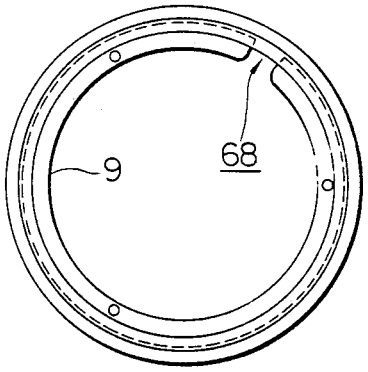
FIG. 9 is a diagram of assistance in explaining the state where the conventional type of the mounting plate is fitted to the cylindrical part.

The shape of the cut-away part 60 of the mounting plate 61 in this invention is not limited to a shouldered shape as shown in FIG. 6, but may be a straight shape without such a shouldered part, as shown by the cut-away part 68 in FIG. 9. In short, the cut-away part may be of any shape that can be effectively crimped.

As described above, a combination of an alnico magnet and a ferrite magnet used as the permanent magnet in this invention can take advantage of the merits of each type of the magnet while reducing the demerits thereof, compared with the single use of each type of magnet. That is, when both types of magnets are used in combination, the alnico magnet can reduce the deteriorated magnetic properties of the ferrite magnet at elevated temperatures, whereby reducing the difference in compressor performance immediately after the start of operation and during steady-state operation, and preventing the risk of the piston colliding against the discharge valve immediately after the start of operation. As to the deteriorated magnetic properties of the two types of magnets at a temperature rise of 100° C., the following test results have been obtained.

Ferrite magnet used singly: Down approx. 18%
Alnico magnet used singly: Down approx. 2%
Ferrite magnet+alnico magnet: Down approx. 5%

(The deterioration for the combined use of magnets varies with the difference in the ratio of magnetic forces of the magnets combined.)

Furthermore, the demagnetization experienced with an alnico magnet when an excess drive current flows can be prevented by the presence of a ferrite magnet. In addition, the combined use of a ferrite magnet, which is less expensive than an alnico magnet, leads to a substantial reduction in manufacturing costs, compared with the single use of an alnico magnet, and results in a more compact compressor due to the reduced height of the alnico magnet.

This invention also makes it possible to prevent the unwanted vibration of the compressor proper, and prevent the wear of cushioning members by installing wear-resistant sliding plates in the sliding portion of a cushioning device provided to prevent the vibration of the compressor.

This invention also makes it possible to securely hold in position the mounting plate used as a means for fixing the yoke and the closing member, thus making it possible to provide a vibrating compressor in which the yoke and the closing member can be brought into a stably secured state, using a simple fixing means.

What is claimed is:

1. A vibrating compressor having a cup-shaped external iron core comprising a bottom and an cylindrical part; a closing member closing the open end face of said external iron core cylindrical part; a permanent magnet disposed inside said external iron core; an internal iron core having a cylindrical magnetic pole for forming a magnetic path, together with said external iron core, with respect to said permanent magnet; and a driving coil vibratably supported by a mechanical vibrating system and disposed within an annular magnetic gap between said external iron core and said internal iron core; said driving coil driving a piston connected thereto when an alternating current is fed to said driving coil, and characterized in that said permanent magnet consists of a high residual magnetic flux density magnet, as represented by an alnico magnet, and a high coercive force magnet, as represented by a ferrite magnet; said high residual magnetic flux density magnet being disposed in between said bottom of said external iron core and said internal iron core; and said high coercive force magnet being disposed in between said cylindrical part of said external iron core and said internal iron core.

2. A vibrating compressor set forth in claim (1) wherein said external iron core has a cylindrical part and a cup-shaped bottom which is in contact with one end face of said cylindrical part, whose inside diameter is smaller than the inside diameter of said cylindrical part, and a part of whose outside diameter is in contact with the inside surface of said cylindrical part; said permanent magnet facing said driving coil being disposed in such a manner that the outer circumferential surface of said permanent magnet is in contact with the inner circumferential surface of said cylindrical part without any air gap and one end face of said permanent magnet is in contact with the open end face of said bottom.

3. A vibrating compressor set forth in claim (1) wherein both ends of a compressor proper comprising said permanent magnet, said cylindrical magnetic pole, said external iron core, said internal iron core and said driving coil have annular projections of a small diameter, and cushioning portions for engaging with said projections; said cushioning portions comprising a doughnut-shaped resilient piece, inner and outer cylindrical portions; said resilient piece being interposed between inner and outer cylindrical portions; said inner cylindrical portion being made of a wear-resistant material; said outer cylindrical portion being fixedly fitted to a housing; and said projection being guided into said inner cylindrical portion.

4. A vibrating compressor set forth in claim (3) wherein said wear-resistant material is plastic, and said resilient piece is made of rubber.

5. A vibrating compressor set forth in claim (3) wherein the top part of said resilient piece is protruded from said inner and outer cylindrical portions; and a gap between the top surface of said resilient piece and the shoulder of a protruded portion of said compressor proper is smaller than a gap between the top surface of said protruded portion and the bottom part of said outer cylindrical portion.

6. A vibrating compressor set forth in claim (3) wherein said cushioning portion has a wave washer having an elastic coefficient smaller than the elastic coefficient of said resilient piece in between said resilient piece and said outer cylindrical portion.

7. A vibrating compressor set forth in claim (1) wherein said external iron core has a mounting groove provided along the entire periphery of the inner circumferential surface of said external iron core cylindrical part at one end, a projection provided on said mounting groove, a mounting plate, made of a resilient material, formed into a ring-shaped disk with the part thereof being cut away, having a plurality of screw holes on said ring-shaped disk and positioning holes at locations close to both ends of said ring-shaped disk; said closing member is fixedly fitted to said one end of said external iron core by means of screws screwed into said screw holes on said mounting plate; and said mounting plate is held in position by forcing the entire outer circumferential surface of said mounting plate onto the bottom surface of said mounting groove by expanding said mounting plate outward and crimping said mounting plate by means of said projection.

* * * * *